US008544300B2

(12) United States Patent
Kaneda et al.

(10) Patent No.: US 8,544,300 B2
(45) Date of Patent: Oct. 1, 2013

(54) SOCK

(75) Inventors: Masatoshi Kaneda, Nara (JP); Akinobu Iwaki, Nara (JP); Atsushi Shiraishi, Osaka (JP)

(73) Assignee: Okamoto Corporation, Nara (JP)

( * ) Notice: Subject to any disclaimer, the term of this patent is extended or adjusted under 35 U.S.C. 154(b) by 184 days.

(21) Appl. No.: 13/157,830

(22) Filed: Jun. 10, 2011

(65) Prior Publication Data

US 2011/0302699 A1 Dec. 15, 2011

(30) Foreign Application Priority Data

Jun. 11, 2010 (JP) ..... 2010-134132

(51) Int. Cl.
*D04B 9/46* (2006.01)

(52) U.S. Cl.
USPC ..... 66/186

(58) Field of Classification Search
USPC ..... 66/185, 178 R, 182, 183, 184, 186; 2/239, 241
See application file for complete search history.

(56) References Cited

U.S. PATENT DOCUMENTS

| | | | | |
|---|---|---|---|---|
| 3,338,071 | A * | 8/1967 | Pons et al. | 66/182 |
| 4,104,892 | A * | 8/1978 | Thorneburg | 66/185 |
| 4,898,007 | A * | 2/1990 | Dahlgren | 66/185 |
| 5,211,035 | A * | 5/1993 | Hanson, II | 66/51 |
| 5,603,232 | A * | 2/1997 | Throneburg | 66/185 |
| 5,708,985 | A * | 1/1998 | Ogden | 2/239 |
| D392,795 | S * | 3/1998 | Ogden | D2/980 |
| 5,791,163 | A * | 8/1998 | Throneburg | 66/178 R |
| 6,178,785 | B1 * | 1/2001 | Samata | 66/186 |
| 6,324,874 | B2 * | 12/2001 | Fujimoto | 66/185 |
| 6,708,348 | B1 * | 3/2004 | Romay | 2/239 |
| 7,587,915 | B2 * | 9/2009 | Kaneda | 66/185 |
| 7,614,257 | B2 * | 11/2009 | Araki et al. | 66/185 |
| 7,677,061 | B2 * | 3/2010 | Mori et al. | 66/185 |
| 7,748,240 | B1 * | 7/2010 | Cherneski | 66/185 |
| 7,757,518 | B2 * | 7/2010 | Sho et al. | 66/185 |

FOREIGN PATENT DOCUMENTS

| | | |
|---|---|---|
| JP | 2007-162149 A | 6/2007 |
| JP | 2008-075236 A | 4/2008 |

* cited by examiner

*Primary Examiner* — Danny Worrell
(74) *Attorney, Agent, or Firm* — Brinks Hofer Gilson & Lione

(57) ABSTRACT

To provide a functional area partially within the toe area on the sole side of the sock. Providing a needle-lowering area 1*a* which is knit by needle-lowering knitting and a needle-raising area 2 which is knit by needle-raising knitting at a specified position within the toe area 4 on the sole side of sock S, these being aligned in the course direction, and providing a first functional area 1 in which the needle-lowering area 1*a* and/or the needle-raising area 2 is knit with a functional yarn which differs from the yarn used in knitting the other areas 11 within the toe area 4 on the sole side. A first functional member 1 can be provided within a specified portion of the toe area 4 on the sole side. If the first functional member 1 is knit with a functional yarn having high frictional resistance, it becomes possible to increase the gripping force only of that specified portion.

11 Claims, 6 Drawing Sheets

SOCK

RELATED APPLICATIONS

This application claims priority under 35 U.S.C. §119 to Japanese Patent Application No. 2010-134132 filed on Jun. 11, 2010, the entire content of which is hereby incorporated by reference.

TECHNICAL FIELD

The present invention relates to a sock which can be provided a functional area formed by knitting with a functional yarn having a specified function at a designated position within the toe area on the sole side of the sock.

BACKGROUND ART

When socks are worn while walking, for example, slipping can occur between the sole of the foot and the inner surface of the sock, or between the outer surface of the sock and the insole of the shoe, depending on the type of yarn used in the sock. This can make walking difficult. Moreover, when socks are worn while playing various sports, and slipping occurs between the inside and the outside of the socks, there is insufficient gripping force when the foot kicks off the ground to generate thrust.

Heretofore, there has been disclosed a sock which has an anti-slip area formed at a position adjacent to the heel portion or sole side of the toe tip portion of the sock (e.g., FIG. 2 of Patent Reference 1).

Heretofore, there has also been disclosed a sock which imparts an anti-slip function to the entire toe tip portion and heel portion by knitting up the toe tip portion and the heel portion using a yarn with a high coefficient of friction (e.g., FIG. 1 of Patent Reference 2).

If the motion of walking is separated into the actions of 1) touching the ground with the heel, 2) transferring the weight to the toes, and 3) kicking off the ground from the base of the toes using the large toe, it is the kicking off action of 3) which most affects the intensity of the force which grips the ground to generate thrust.

During the kicking off action of 3), the toes operate independently to naturally spread in the lateral direction, which produces a strong gripping force to obtain a wider contact surface area with the ground.

Thus, if the frictional force can be increased in only certain areas of the sock which correspond to the base of the toes and to the large toe in the toe area on the sole side of the sock, then the gripping force during the kicking off action can be most effectively increased, without interfering with the lateral spreading of the toes.

In the case of socks worn in ball sports, there are instances where the gripping force needs to be high in certain places on the little toe side in the toe area on the sole side of either the right or left sock, or the gripping force needs to be high on both the large toe side and the little toe side, depending on the player's position.

In any of the above cases, it is important to increase the frictional force of only specified portions of the toe area on the sole side. If frictional force is increased in the entire toe area, then this will naturally result in interference with the lateral spreading of the toes.

However, in the above described prior art sock, as, for example, the sock disclosed in Patent Reference 1, there was the problem that it was impossible to increase the gripping force of portions corresponding to the large toe, for example, because an anti-slip area was provided at a position adjacent to the sole side other than the toe area, rather than providing an anti-slip area within the toe area on the sole side. For the same reason, it was also impossible to increase the gripping force on the little toe side, and it was also impossible to increase the gripping force on both the large toe side and the little toe side.

The technology disclosed in Patent Reference 1 was able to provide an anti-slip area using reciprocating rotation knitting in the foot portion knitted with normal cylinder rotation of a circular knitting machine. However, if an attempt was made to provide an anti-slip area by employing reciprocating rotation knitting in the toe area, there was the problem that the basic shape of the toe area of the sock could no longer be maintained.

There was also the problem that it was impossible to provide a functional area by performing reciprocating rotation knitting in the toe area, even when using functional yarns not only of a type with high frictional resistance, but also functional yarns with high durability and high water absorption properties. In other words, the problems of the prior art were not due to the type of functional yarns used, but rather, because it was impossible to place functional areas in parts of the toe area on the sole side of the sock.

There was the additional problem that the anti-slip effect was insufficient, because no consideration was given to increasing the frictional force between the sole of the foot and the inner side surface of the sock.

The sock of Patent Reference 2 had the problem that there was less freedom for the toes to spread during the kicking off action because the anti-slip effect is provided to the entire toe area. Thus, in this prior art technology, there was the risk of impeding the motion of walking, because the anti-slip effect extended to areas where it was not needed.

Patent Reference 1: Japanese Laid-Open Patent Application No. 2008-75236

Patent Reference 2: Japanese Laid-Open Patent Application No. 2007-162149

The problem to be solved by the present invention is that in the prior art sock, it was impossible to provide a functional area only in a specified area within the toe area on the sole side of the sock.

SUMMARY OF THE INVENTION

The sock of the present invention is a sock provided with a needle-lowering area which is knitted by needle-lowering knitting and a needle-raising area which is knitted by needle-raising knitting at a specified position within the toe area on the sole side of the sock, and in alignment with the course direction. The most essential feature of the present invention is that a first functional area in which the needle-lowering area and/or the needle-raising area is knitted with a functional yarn which differs from the yarn used in knitting the other areas within the toe area on the sole side.

According to the present invention, it becomes possible to provide a functional area partially within the toe area on the sole side of the sock, by having a first functional area knitted with a specified functional yarn knitting at a specified position within the toe area on the sole side of the sock which comprises the needle-lowering area knitted by needle-lowering knitting and/or the needle-raising area knitted by needle-raising. This makes it possible to increase the gripping force of a specified portion of the toe portion on the sole side of the sock, without interfering with the natural spreading of the toes during the kicking off action, in cases where the first functional area is knitted with a functional yarn having high frictional resistance.

DETAILED DESCRIPTION OF THE PREFERRED EMBODIMENTS

Figure 1:
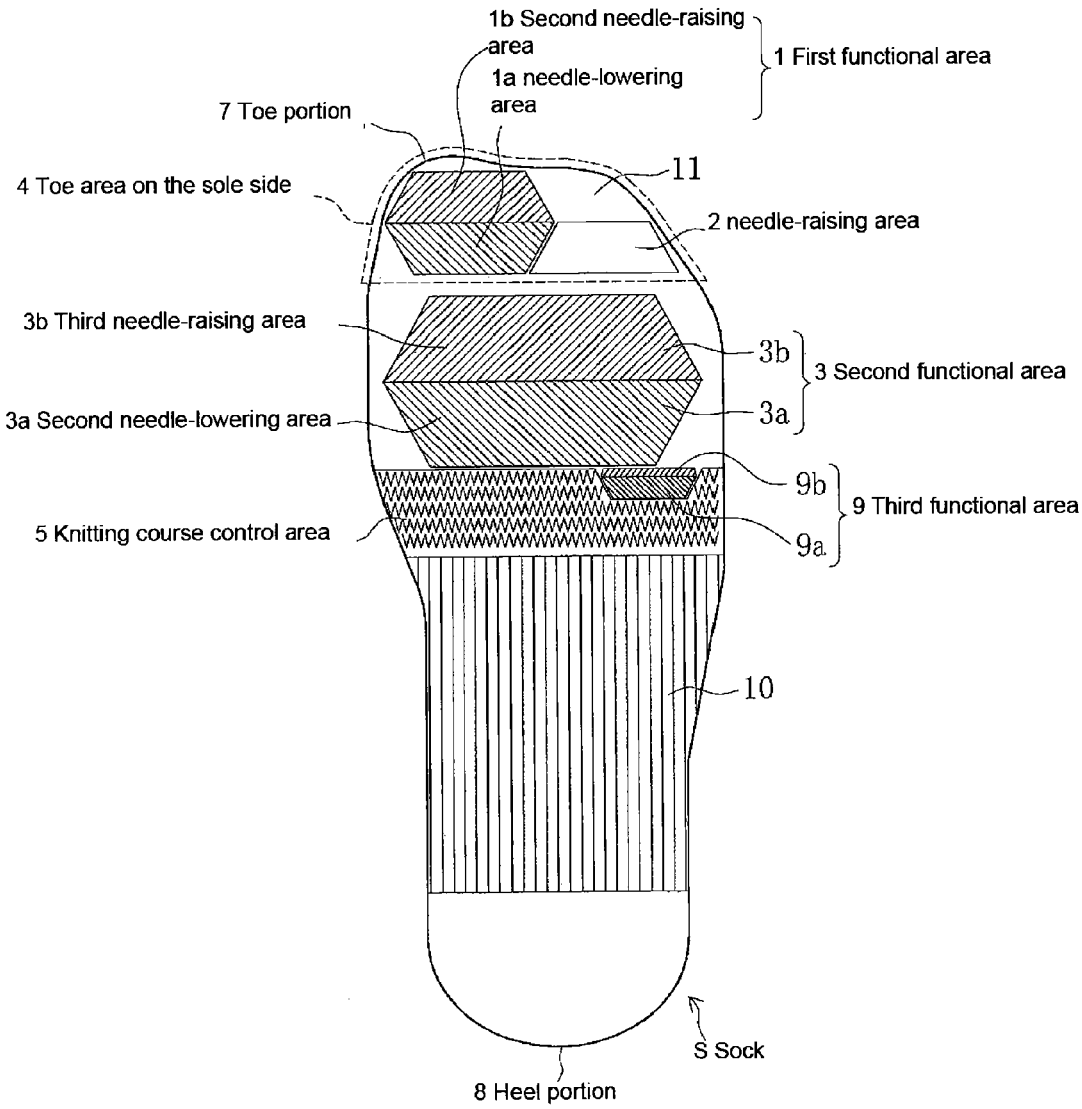
FIG. 1 is a drawing describing an embodiment of the sock of the present invention. The drawing shows a sock for the left foot viewed from the sole side.

In order for the sock of the present invention to achieve the purpose of providing a functional area only in a specified portion within the toe area on the sole side of the sock, a structure was employed such that a needle-lowering area which is knitted by needle-lowering knitting and a needle-raising area which is knitted by needle-raising knitting are provided at a specified position within the toe area on the sole side of the sock, and in alignment with the course direction, and a first functional area, which comprises the needle-lowering area and/or the needle-raising area is knitted with a functional yarn which differs from the yarn used in knitting the other areas within the toe area on the sole side (Embodiment 1).

Needle-lowering knitting refers to knitting which serves to widen the stitching by lowering the needle from a non-knitting level to a knitting level, using a dropper, at the cylinder of a circular knitting machine's each reciprocating rotation, for example, during normal or reverse rotation. Thus, the needle-lowering area where the stitching is widened by needle-lowering knitting has an inverse trapezoidal configuration, when the knitting direction is viewed from above.

Needle-raising knitting refers to knitting which serves to narrow the stitching by raising the needle from the knitting level to the non-knitting level, using a picker, at the cylinder of a circular knitting machine's each reciprocating rotation, for example, during normal or reverse rotation. Thus, the needle-raising area where the stitching is narrowed by needle-raising knitting has a trapezoidal configuration, when the knitting direction is viewed from above.

In the above-described sock of the present invention, the shape needed for the toe portion of the sock can be maintained, even when a high anti-slip effect using reciprocating rotation knitting is provided in the toe area, because an inverse trapezoidal area and a trapezoidal area are in alignment with the course direction by aligning the needle-lowering area and the needle-raising area.

A functional yarn is a yarn which differs from an ordinary yarn, in that it is provided with a specified function. Examples include high friction yarn, high durability yarn, bulk yarn, high water absorption yarn, and the like.

If the first functional area is knitted with a high durability yarn, the useful life of the product can be extended by increasing the durability of the toe portion, which readily wears out with long-term use. An example of a high water absorption yarn is an aramid fiber such as "Kevlar" (registered trade name, Toray-Dupont). In particular, according to the present invention, it is possible to perform knitting with a high durability yarn only in specified portions which readily wear out, such as the tip of the sock from the large toe to the index toe.

When the first functional area is knitted with a bulk yarn, the cushioning properties of the toe portion are enhanced, which makes it possible to absorb shock. Examples of bulk yarn include nylon processed yarn and polyester processed yarn. In particular, according to the present invention, it is possible to perform knitting with a bulk yarn only in specified portions which are subjected to force during walking, such as the portion where the toe makes contact with the ground.

When the first functional area is knitted with a high water absorption yarn, the toe portion, which readily becomes damp, can be kept dry. Examples of high moisture absorption yarns include yarns with irregular cross sections and yarns with a monofilament diameter on the level of several μm-nm. In particular, according to the present invention, it is possible to perform knitting with a high water absorption yarn only in portions which readily become damp, such as between the large toe and the index toe.

The needle-lowering area or the needle-raising area can be selected as an area with high frictional resistance as desired, depending on what the sock is used for. Moreover, the position and surface area of the first functional area can be set as desired, by controlling the knitting surface area of the needle-lowering area and the needle-raising area.

The sock of the present invention is a sock knitted from the opening welt of the sock to the toe portion, having the needle-lowering area positioned on the large toe side, and the needle-raising area positioned on the little toe side, with the knit end of the needle-lowering area serving as the knitting starting end in the wale direction to also form a second needle-raising area, and the needle-lowering area and the second needle-raising area are knitted so as to contain functional yarns in a specified ratio, thereby making it possible to form a first functional area (Embodiment 2).

According to Embodiment 2 above, it is possible to provide a first functional area which has a hexagonal shape which is in line with the expansion of the surface on the large toe side in the entire large toe area.

In the sock of the present invention, if the first functional area is knitted so that functional yarns with higher frictional resistance than the yarns forming other areas within the toe area on the sole side of the sock are contained in a specified ratio, then it becomes possible to advantageously adjust the frictional resistance of the first functional area by varying the ratio of the functional yarns contained in the first functional area (Embodiment 3).

In the sock of the present invention, if the band forming the base of the toes of the sole is knitted to contain functional yarns in a specified ratio to form a second functional area, then it becomes possible to increase the gripping force of the base of the toes which exerts pressure when the body weight shifts from the heel to the toes while making contact with the ground during walking (Embodiment 4).

Here, the base of the toes refers to the portion of the sole which touches the ground and corresponds to the metatarsophalangeal joints which are joints between metatarsal bones 1-5 and proximal phalanges 1-5. The band forming the base of the toes refers to in the vicinity of the sole side of the middle toe joint.

In the sock of the present invention, if the first functional area and the second functional area are knitted only with functional yarns, then functional yarns with high anti-slip effect are exposed on both the inner and outer surfaces of the knit fabric of the sole portion, making it possible to inhibit slipping not only between the sock and the insole of the shoe, but also between the sole of the foot and the sock (Embodiment 5).

In the sock of Embodiment 4, if the second functional area is cut boss knit with the functional yarn as an inlay yarn, this makes it possible to give the second functional area a flat shape (Embodiment 6).

Cut boss knitting refers to a method of knitting in which another yarn is inlaid in a portion of the area of a knit fabric formed from the base yarns. Generally, this method is often used for design purposes, but in the present invention, a functional yarn with high frictional resistance is inlaid into the band forming the base of the toes, with the purpose of imparting an anti-slip function.

In the sock of Embodiment 4 or Embodiment 5, if the second functional area is provided by knitting a second needle-lowering area by needle-lowering knitting, after which a third needle-raising area is knitted by continuous needle-raising knitting, then this makes it possible for the second functional area to have a shape which is in line with the expansion of the band forming the base of the toes, thereby improving the fit with the sole of the foot (Embodiment 7).

In other words, Embodiments 6 and 7 are variations on the shape of the second functional area. These embodiments can be suitably selected according to the desired function.

In the sock of Embodiments 4 to 7, it is more desirable to provide a knitting course control area with a tighter knit in the periphery on the sole half than on the top half of the sock, so as to be adjacent to the heel side of the second functional area (Embodiment 8).

In Embodiment 8, discomfort due to fabric sagging while wearing the sock can be eliminated, because the tightly knit knitting course control area absorbs the length of the fabric on the sole side that develops due to providing the second functional area. In addition, it is possible to advantageously arrange the second functional area in a position intended to be at the base of the toes, because the second functional area, which tends toward the toe side, is drawn toward the heel side.

When Embodiment 8 is employed, if the knitting course control area is knitted by tuck knitting, with 25-45 courses in the sole half of the sock, and 55-75 courses in the top half of the sock, it becomes possible to advantageously arrange the second functional area in a suitable position (Embodiment 9).

The functional yarns used in the sock of the present invention are twisted yarns which are floating yarns twisted around core yarns, which are then twisted with slack yarns. Polyurethane can be used for the core yarns, and wooly nylon can be used for the floating yarns. It is more advantageous to use high friction yarns for which the relationship $A-B \geq 50$ Decitex stands where the core yarns have a thickness of A Decitex and the floating yarns have a thickness of B Decitex (Embodiment 10).

Instead of using the above high friction yarns, it is also advantageous to use raw yarns with a total filament grade of 30 Decitex or more, and formed from one or more filaments with a monofilament diameter of 1,000 nm or less (Embodiment 11).

The combination of the above high friction yarns and raw yarns can be determined as one pleases. For example, in Embodiment 6, the above high friction yarn may be used as the functional yarn in the first functional area, and the above raw yarn may be used in the inlay yarn in cut boss knitting of the second functional area. Moreover, in Embodiment 7, for example, the above high friction yarn may be used together with the first functional area and the second functional area, and the above raw yarn may also be used.

Figure 2:
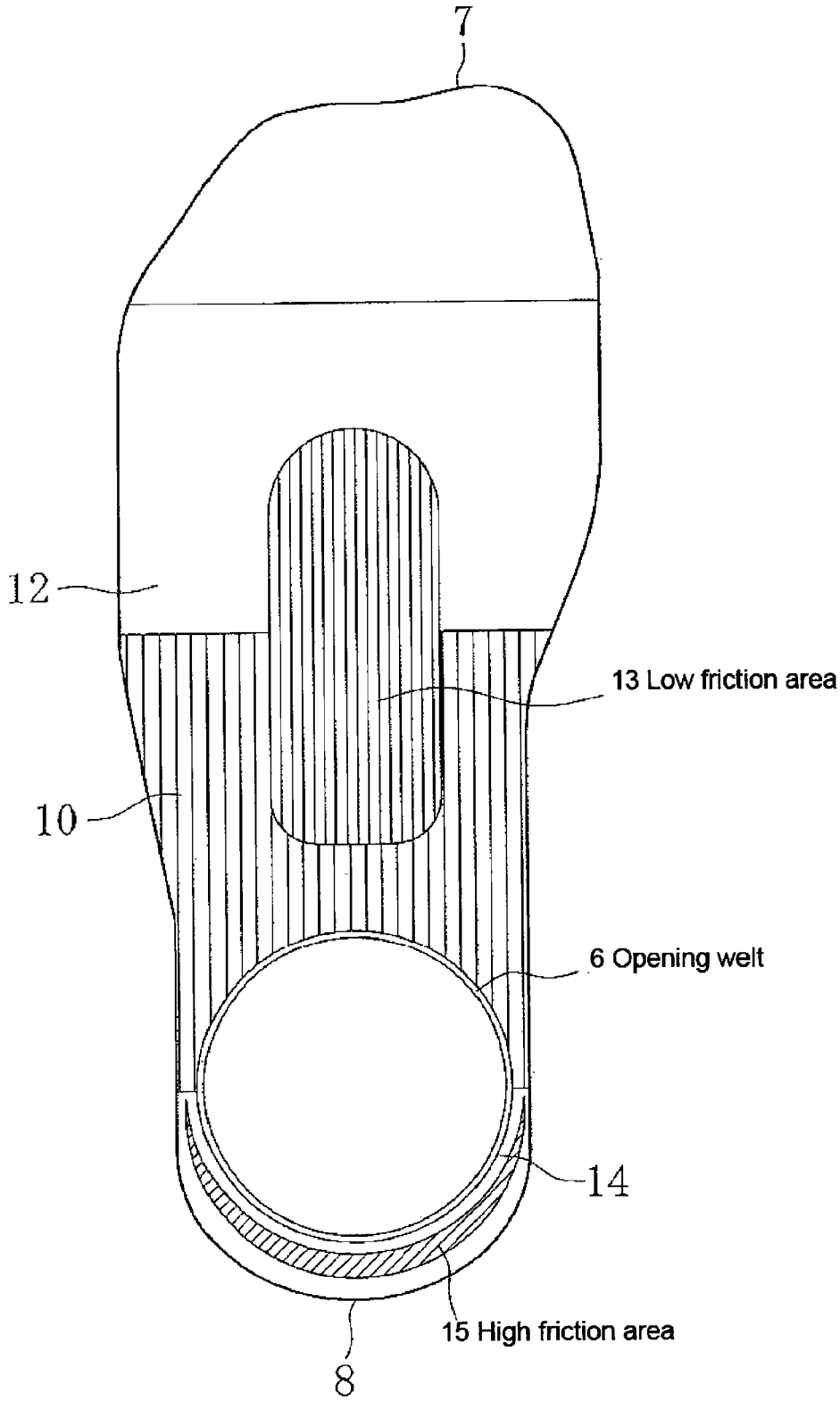
FIG. 2 is a drawing of the sock of the embodiment of FIG. 1 viewed from the top side.

Following is a description of various embodiments of the present invention, making use of the appended drawings. The example shown in FIG. 1 and FIG. 2 is a sock for the left foot. FIG. 1 illustrates the sock as viewed from the sole side, and FIG. 2 illustrates the sock as viewed from the top.

Reference Symbol S is a sock of the present embodiments in which a needle-lowering area 1*a* where the stitching is widened by needle-lowering knitting during reciprocating rotation of the cylinder is positioned from the base of the toes within the toe area 4 on the sole side of the sock, and a needle-raising area 2 where the stitching is narrowed by needle-raising knitting during reciprocating rotation of the cylinder and in alignment with the course direction. The needle-lowering area 1*a* serves as the first functional area which is knitted with functional yarns having higher frictional resistance than the knitting yarns of another area 11 within the toe area on the sole side of the sock. The sock S is knitted in the direction from the opening welt 6 to the toe portion 7. Reference Symbol 8 is the heel portion, 10 is the foot portion, and 14 is the leg portion.

As shown in FIG. 1, the needle-lowering area 1*a* and the needle-raising area 2 are adjacently positioned in the course direction, so that the lower end of these areas line up in the same straight line, and so that the diagonal portions of each area touch. Accordingly, it is possible to provide a first functional area with a high anti-slip effect only in the portion of the toe area 4 on the sole side of the sock, while the toe area 4 on the sole side of the sock keeps its typical shape as the toe portion, because the needle-lowering area 1*a* with an inverse trapezoidal shape and the needle-raising area 2 are adjacently positioned in the course direction.

In the past, functional yarns with high frictional resistance could not be knitted under stable tension, since friction arose between the latch needle and the guide during knitting, and this resulted in poorer product quality and productivity. Accordingly, in the sock S of the present embodiments, after applying fixed tension to twist floating yarns around core yarns, they were then twisted with slack yarns. The high friction yarns are 311 DT polyurethane used for the core yarns, and 33 DT/2 wooly nylon used for the slack yarns and the floating yarns.

Thus, when high friction yarns are used in this example, polyurethane, which serves the anti-slip function, is suitably exposed, and friction is reduced between the slit and the guide when the floating yarns are knitted, and the slack yarns can be knitted to serve the purpose of reducing the bending and slippage between the polyurethane and the floating yarns so as to anchor them, and also to serve as functional yarns with a high anti-slip effect, without negatively affecting product quality and productivity.

In addition to the above, 33 DT/2 wooly nylon may be used in the core yarns and the slack yarns, and 311 DT polyurethane may be used in the floating yarns, and when twisting is performed, the floating yarns are first twisted on the core yarns, while feeding to a yarn twisting machine in a ratio of 1.2 floating yarns to 1 core yarn, and then slack yarns are twisted to produce twisted yarn A, and in order to impart a firmer anti-slip effect, a high friction yarn may be used which is double knitted using a 311 DT polyurethane yarn B. This makes it possible to support product quality and productivity, and to maximize the anti-slip function.

When high friction yarns are double knitted with twisted yarn A and polyurethane yarn B, if the feed ratio of floating yarns to core yarns becomes lower than 1.1, then the loops of the polyurethane of the floating yarns are too small, making it impossible to produce a good gripping force. If the feed ratio of the of the floating yarns to the core yarns exceeds 1.3, then the loops of the polyurethane are too large, resulting in excessive friction between the knitted yarns and the slits, making it impossible to stably feed the knitted yarns. Thus, when high friction yarns double knitted with twisted yarn A and polyurethane yarn B are used, the feed ratio of the floating yarns to the core yarns of the twisted yarn A is preferably 1.1 or higher and 1.3 or lower, with a ratio of 1.2 being most advantageous.

As shown in FIG. 1, the sock S of this example has the needle-lowering area 1*a* arranged on the large toe side, and the needle-raising area 2 arranged on the little toe side, and with the knitted end of the needle-lowering area serving as the knitting starting end in the wale direction to also form a second needle-raising area 1*b*. The second needle-raising area 1*b* is knitted with the same high friction yarns as the needle-lowering area 1*a*, and together with the needle-lowering area 1*a*, the first functional area 1 is formed to raise the anti-slip effect of the large toe portion.

Thus, there is achieved an enhanced kicking off force during walking, because there is a greater e gripping force for the portion corresponding to the large toe.

In the case of a structure such as that described above, a hexagonal first functional area 1 is formed with the trapezoidal second needle-raising area 1*b* being continuous with the inverse trapezoidal needle-lowering area 1*a* above it. Thus, there results an enhanced fit with the large toe, because the first functional area 1 can be caused be in line with the expansion of the body of the large toe.

Moreover, in the case of a structure such as that described above, the shape of the sock approaches an oblique shape, enhancing the fit to the flat configuration of the foot, because the large toe side projects suitably in comparison with the little toe side, due to the fact that the second needle-raising area 1*b* is in alignment with the wale direction.

Incidentally, the human foot can be of the oblique shape, which describes a characteristic curve in which there is a peak at the large toe, and a gradual shortening as it approaches the little toe, and a rounded shape, which describes an almost symmetric curve in which there is a peak near the middle toe. People with the oblique shape are reported to be more prevalent. However, in the prior art, many socks had a shape nearing the rounded shape, in order to simplify the production process. If a person having a foot with an oblique shape wears a rounded sock, there is the problem that a tugging feeling arose on the large toe side, which makes it uncomfortable to wear. A sock S of this example has a shape close to the oblique shape, is thus favorable from this standpoint.

In the sock S of this example, the band forming the base of the toes of the sole is knitted with a high friction yarn identical to that of the first functional area, to serve as the second functional area 3. Thus, this is advantageous, because the gripping force of the band forming the base of the toes of the sole which exerts pressure when the body weight shifts from the heel to the toes while making contact with the ground during walking can be increased. It is thus possible to increase the gripping force of both the toe portion and the band forming the base of the toes of the sole.

In the sock S of this example, the first functional area 1 and the second functional area 3 are both knitted only with high friction yarns. It is therefore possible to inhibit slipping not only between the sock and the sole of the shoe, but also between the sole of the foot and the sock, because yarns with high frictional resistance are exposed on the inner and outer surfaces of the knitted fabric of the sole portion, and this also enhances the gripping force.

The second functional area 3 is provided by knitting a second needle-lowering area 3*a* with widened stitches by needle-lowering knitting with reciprocating rotation of the cylinder, and then a third needle-raising area 3*b* with narrowed stitches is knitted by continuous needle-raising knitting with reciprocating rotation of the cylinder. This makes it possible for the second functional area 3 to have a shape which is in line with the expansion of the band forming the base of the toes, as shown in FIG. 1, thereby improving the fit with the sole of the foot.

In the sock S of this example, the sole half of the sock is provided with a knitting course control area 5 having more stitches than the top half of the sock shown by Reference Symbol 12, so as to be adjacent to the heel side of the second functional area 3. The knitting course control area 5 thus makes it possible to absorb the sagging of fabric on the sole side resulting from the second functional area 3, and there is no uncomfortable feeling due to sagging of the fabric when wearing the sock. A good fit with the sole of the foot can also be maintained, because the second functional area 3 can be accurately arranged in a position corresponding to the base of the toes.

In further detail, the knitting course control area 5 is knitted with tuck knitting with 25-45 courses in the bottom half of the sock, and 55-75 courses in the top half of the sock.

If the knitting course control area 5 provided to the sole side exceeds 45 courses as compared with 55-75 courses in the top half of the sock, a tight feeling occurs when worn, because the fabric of the sole side is pulled beyond what is necessary. Conversely, if the knitting course control area 5 provided to the sole side is less than 25 courses, there is a risk that the effect of controlling sagging of the fabric will be insufficient. Thus, it is advantageous for the knitting course control area 5, which is knitted by tuck knitting, have 25-45 courses in the bottom half of the sock, and 55-75 courses in the top half of the sock.

In FIG. 1, Reference Symbol 9 is a third functional area which is provided in a position on the little toe side of the lower portion of the area of the base of the toes, composed of a third needle-lowering area 9*a* where the stitching is widened by needle-lowering knitting, and a fourth needle-raising area 9*b* where the stitching is narrowed by needle-raising knitting. This makes it possible to increase the gripping force on the little toe side of the lower portion of the area of the base of the toes.

In FIG. 2, Reference Symbol 13 shows a low friction area with improved slipping in the instep area, due to the knitting in of wooly nylon yarns. Reference Symbol 15 shows a high friction area which makes slipping difficult in the heel area, resulting from knitting into the heel area with high friction yarns identical to those of the first functional area 1 and the second functional area 3. By providing this combination of areas, walking can become more comfortable.

EXAMPLES

The present invention is described in further detail with examples below. The present invention is not limited to socks produced using the knitting methods described below.

Figure 3:
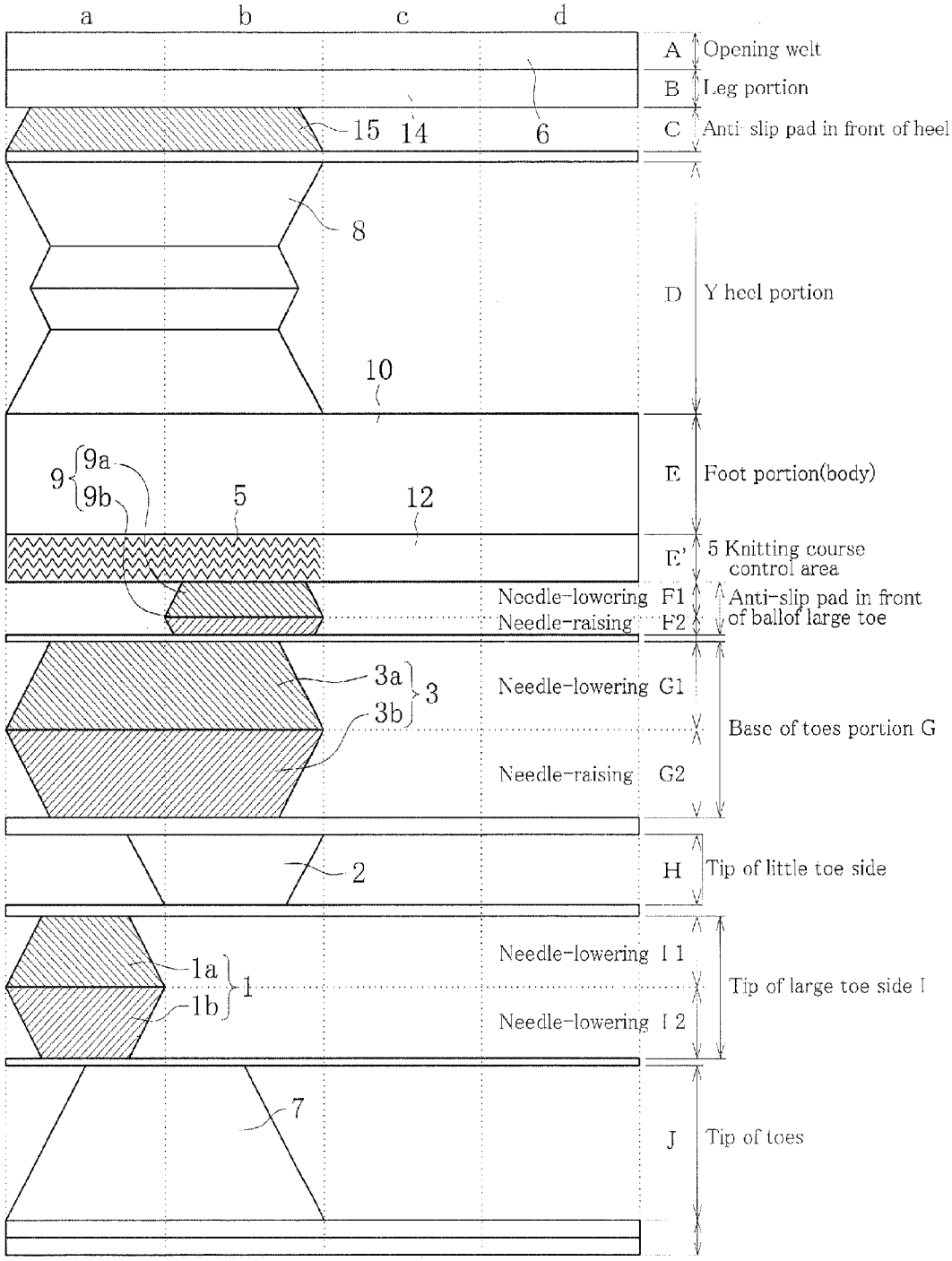
FIG. 3 is a development diagram describing the knitting process of the sock of the present invention.

FIG. 3 is a development diagram of the sock of FIG. 1. The upper end is the starting position of knitting, and the lower end is the final position of knitting, and the development diagram shows the knitted areas in time sequence. In the development diagram, the areas shown with diagonal lines are all needle-lowering areas or needle-raising areas using high friction yarns. The high friction yarns are twisted yarns which are floating yarns twisted around core yarns, which are then twisted with slack yarns. Polyurethane is used for the core yarns, and wooly nylon is used for the floating yarns. If the core yarns have a thickness of A Decitex and the floating yarns have a thickness of B Decitex, then the relationship A−B≥50 Decitex stands. The high friction yarns use 311 DT polyurethane for the core yarns and 33 DT/2 wooly nylon for the floating yarns and the slack yarns.

Figure 4:
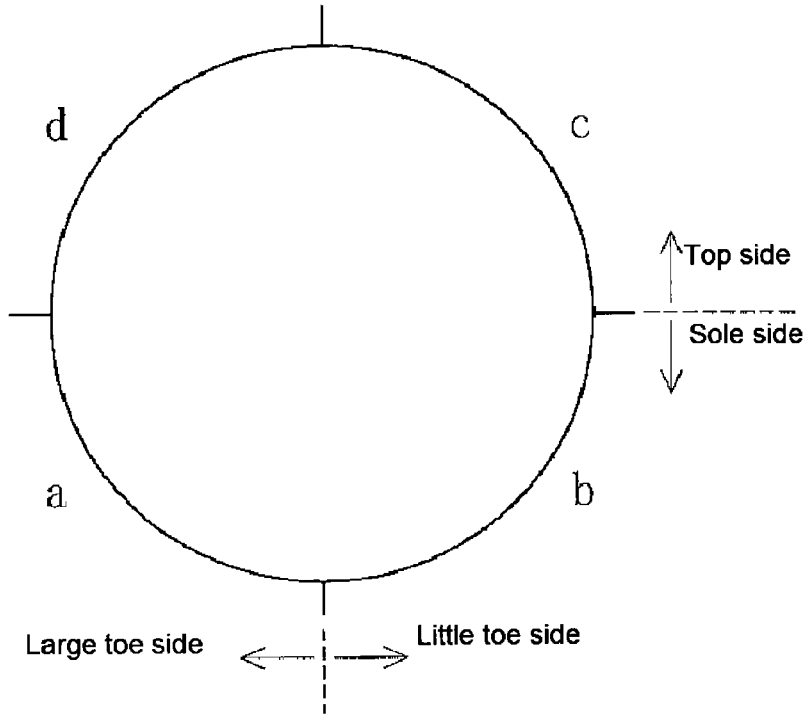
FIG. 4 is a drawing describing the positions of reference characters a-d in the development diagram of FIG. 3.

FIG. 4 is a drawing describing the position along the line a-d in the development diagram of FIG. 3. The horizontal width of development diagram 3 corresponds to the length of one rotation of the cylinder, and the range shown by the Reference symbols a-d respectively correspond to ¼ of the circumference of the cylinder. Specifically, a corresponds to half of the large toe side on the sole side, b corresponds to half of the little toe side on the sole side, c corresponds to half of the little toe side on the top side, and d corresponds to half of the large toe side on the top side.

Below is a description of the knitting method for each area, successively in time sequence. First, area A is knitted, corresponding to the opening welt 6 of the sock, and then area B is knitted, corresponding to the leg portion 14. Since the sock of this example is of the short height type, area B has the same number of courses as area A.

Next, area C is knitted, corresponding to the high friction area 15 provided to the heel portion 8, using needle-lowering knitting by reciprocating rotation of the cylinder, and using only high friction yarn. Accordingly, slipping and falling down of the sock can be prevented, and conformity to the shoe and comfortable fit are improved, because it is possible to prevent slipping inside and outside of the heel portion.

After that, needle-raising knitting and needle-lowering knitting are each repeated twice to form a Y-shaped gore line, and area D is formed, corresponding to the Y heel of the heel portion 8. Accordingly, the leg portion 14 is set at about 90 degrees to the foot portion 10, forming a sock which follows the shape of the foot.

Area E, which corresponds to the foot portion 10, is knitted with 60 courses with plain knitting in the top half of the sock, and with 30 courses with tuck knitting in the sole half of the sock. Tuck knitting increases the knitting density, and suppresses swelling of the fabric of area G and are I described later, and this makes it possible to place the second functional area 3 in an advantageous position.

Next, area F, which corresponds to the third functional area 9 (the third needle-lowering area 9*a* and the fourth needle-raising area 9*b*), is formed by needle-lowering knitting and needle-raising knitting using only high friction yarns. This makes it possible to increase the gripping force of the little toe side of the lower portion of the area of the base of the toes.

Area G, corresponding to the second functional area 3 (second needle-lowering area 3*a* and third needle-raising area 3*b*) is knitted by needle-lowering knitting and needle-raising knitting using only high friction yarns, so as to cover the band forming the base of the toes. This makes it possible to increase the gripping force of the base of the toes, which greatly contributes to increasing the gripping force during walking.

Next, the portion corresponding to the toe area 4 on the sole side of the sock is knitted. First, an area H corresponding to the needle-raising area 2 is knitted by needle-raising knitting on the little toe side, and then, after knitting several courses with plain knitting, an area 11 corresponding to the needle-lowering area 1*a* is knitted by needle-lowering knitting on the large toe side. Then, the first functional area 1 is provided by knitting an area 12 corresponding to the second needle-raising area 1*b* continuously in the wale direction. Finally, the top side of the nail tip portion J is knitted. It is thus possible to form the first functional area 1 with higher frictional force in specified areas within the toe area 4 on the sole side of the sock.

Following is a description of Test 1 for evaluating the frictional resistance of the high friction yarns used in the first functional area and the second functional area of the sock of the present invention, as well as a description of Test 2 for evaluating the effectiveness of the sock of the present invention.

Test 1

The purpose of Test 1 is to measure and evaluate the frictional resistance of the high friction yarns used in the first functional area and in the second functional area.

The specimens from the examples were Ny30/2 functional yarns covering Pu100d and FTY30/35 under yarns, produced in a size of 20×8.5 cm. The knitting stitches were of three varieties: plain, 1×2 tuck, and 2×1 tuck knits. The specimens from the comparative examples (blank) were fabrics for undershirts (Bresse plain knit fabrics), of the same size as the specimens from the examples.

Figure 5:
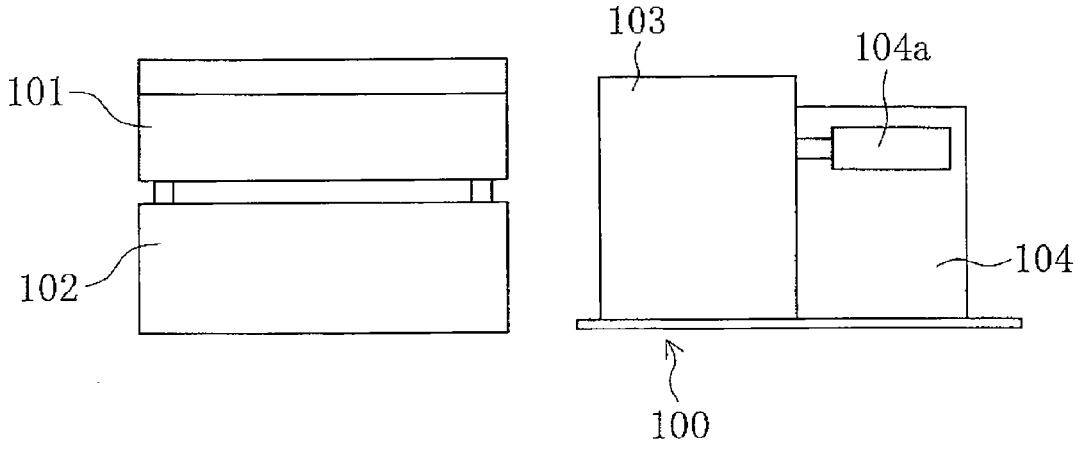
FIG. 5 is a schematic diagram of a testing apparatus used for measuring frictional resistance.

Frictional resistance was measured using a frictional resistance measuring apparatus while lubricating for wear. The above specimens were tested by the same method used when evaluating wear. As shown in FIG. 5, a drum-type friction force tester (Daiei Kagaku Seiki, model DF-200F) was used.

The drum-type friction force tester is equipped with recording device 101 which records the output from the load converter, a power source, a roller surface speed meter, a load converter, and a control box 102 which houses electrical equipment such as a motor speed controller for the friction roller. The main body 100 has a measuring unit 104 with a drive apparatus 103 equipped with a motor for rotating roller 104*a* and a rotary encoder for detecting the speed, and the roller 104*a* is attached to a plastic dessicator.

Preparation of Specimens

Specimens from the examples and comparative examples were first left in a constant-temperature constant-humidity vessel at temperature 20±2° C. and humidity 65±2% RH for 12 hours, before using as sample pieces.

Test Apparatus Settings

The test apparatus was set for testing according to procedures (1)-(5) below.

(1) The constant-temperature constant-humidity chamber housing the test apparatus was pre-set at temperature 20±2° C. and humidity 65±2% RH, so that the temperature and humidity were stable.

(2) The main body 100 and the recording device 101 of the drum-type friction force tester were switched ON.

(3) The main body 100 was set so that the roller 104*a* had a diameter of 50 mm, a friction speed of 4 cm/min, with the roller speed set with an automatic switch.

(4) The recording device 101 was switched with a measuring switch, and the range was set at 1 V.

(5) A ZERO dial was adjusted so that the recording device registered 0 when the CAL/OFF switch was at OFF, and the SPAN dial was adjusted so that the recording device registered 100 when the CAL/OFF switch was at CAL. Once these adjustments were completed, the CAL/OFF switch was at OFF.

Setting of Specimens

A metal fitting was attached for holding the specimens on the test apparatus at 5 mm from the end of each specimen. A double-sided tape with a width of 1 cm was attached to the metal fitting in advance.

Testing Method

Frictional resistance of the specimens was measured using procedures (1)-(6) below.

(1) The metal fitting with the attached specimen was mounted onto the test apparatus, so that the fabric surface of the specimen touched the roller 104*a*.

(2) A 30 g weight was attached to the end of the specimen not attached to the metal fitting.

(3) The start button on the main body was pressed.

(4) Measured values were recorded with the recording device 101 in a stable position to operate.

(5) The measured values were expressed in terms of the frictional resistance (g) of the specimen.

(6) Measurements were taken twice, for the surface and underside of each specimen, and then averaged.

Measurement Results

Figure 6:
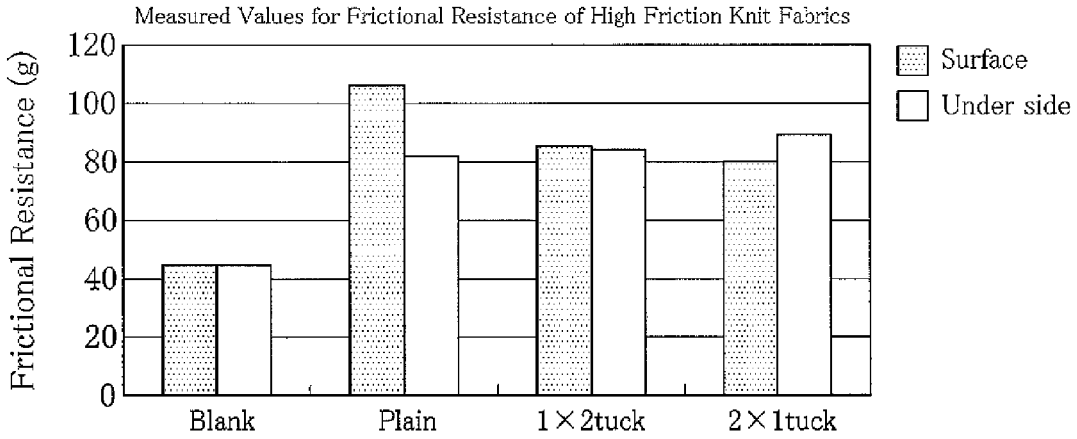
FIG. 6 is a graph showing measurements of frictional resistance of a knit fabric formed from the high friction yarn used in the first functional area of the sock of the present invention.

FIG. 6 is a graph showing the measurement results (average of two measurements) of Test 1. TABLE 1 below shows the data for the first measurement, second measurement, and average.

TABLE 1

| | | | Knitting stitches using functional yarns of this example | | |
|---|---|---|---|---|---|
| | | Blank | Plain | 1 × 2 tuck | 2 × 1 tuck |
| Top | First time | 45 | 108 | 87 | 80 |
| | Second time | 45 | 101 | 82 | 78 |
| | Average | 45 | 105 | 85 | 79 |
| Bottom | First time | 45 | 78 | 82 | 86 |
| | Second time | 45 | 84 | 84 | 88 |
| | Average | 45 | 81 | 83 | 87 |

Unit: (g)

Discussion

Three types of knitted stitches using high friction yarns were used in the first functional area and the second functional area of the sock of the present invention: Plain, 1×2 tuck, and 2×1 tuck. In all three cases, the frictional resistance was found to be greater than in the comparative example (blank) for both the top surface and the bottom surface. In Test 1, since the test specimen used an under yarn, the frictional resistance of the top surface was higher than that of the bottom surface, particularly for the plain knit.

When the plain knit and the tuck knits are compared in the graph of FIG. 6 and TABLE 1, it was found that the frictional force is greater for the flatter knits and smaller for the uneven knits.

The frictional force of the knits also depends on the ratio of polyurethane in the high friction yarns. The greater the percentage of polyurethane, the greater the frictional force, and the lower the percentage of polyurethane, the lower the frictional force. Thus, the frictional resistance of the first functional area and the second functional area can be adjusted to the desired value by adjusting the percentage of polyurethane in the high friction yarn and the degree of unevenness of the knit. The percentage of polyurethane can be increased by using a high filament grade polyurethane yarn, or using multiple polyurethane yarns.

Next, multiple fabrics were prepared, varying the frictional resistance within a range of 41 g to 63 g. Six test subjects walked barefoot on fabric each with a monitor A-F, and the sensations felt on the bottom of the feet were classified into 5 response stages:

1: Slipping
2: Some slipping
3: Sensation is the same with any specimen
4: Slight non-slip
5: No slipping The results are given in TABLE 2 below.

TABLE 2

| | | | | | | | | | | | | | |
|---|---|---|---|---|---|---|---|---|---|---|---|---|---|
| A | Frictional resistance (g) | 41 | 45 | 47 | 49 | 50 | 52 | 54 | 55 | 56 | 59 | 61 | 63 |
| | Sensation | 1 | 1 | 2 | 2 | 2 | 2 | 3 | 4 | 4 | 5 | 5 | 5 |
| B | Frictional resistance (g) | 41 | 45 | 47 | 49 | 50 | 52 | 54 | 55 | 56 | 59 | 61 | 63 |
| | Sensation | 1 | 1 | 1 | 2 | 2 | 3 | 3 | 4 | 5 | 5 | 5 | 5 |
| C | Frictional resistance (g) | 41 | 45 | 47 | 49 | 50 | 52 | 54 | 55 | 56 | 59 | 61 | 63 |
| | Sensation | 1 | 1 | 2 | 2 | 2 | 2 | 3 | 4 | 4 | 5 | 5 | 5 |
| D | Frictional resistance (g) | 41 | 45 | 47 | 49 | 50 | 52 | 54 | 55 | 56 | 59 | 61 | 63 |
| | Sensation | 1 | 1 | 1 | 2 | 2 | 2 | 3 | 4 | 4 | 4 | 5 | 5 |
| E | Frictional resistance (g) | 41 | 45 | 47 | 49 | 50 | 52 | 54 | 55 | 56 | 59 | 61 | 53 |
| | Sensation | 1 | 1 | 2 | 2 | 3 | 3 | 3 | 4 | 4 | 4 | 4 | 5 |
| F | Frictional resistance (g) | 41 | 45 | 47 | 49 | 50 | 52 | 54 | 55 | 56 | 59 | 61 | 63 |
| | Sensation | 1 | 1 | 2 | 2 | 2 | 3 | 3 | 4 | 4 | 5 | 5 | 5 |

The results of TABLE 2 show that when the fictional resistance is 55 g or greater, the monitored value for sensation is 4 or more, and thus "Slight non-slip" or "No slipping" is felt If we re-evaluate the data presented in TABLE 1, we see that in the comparative example (blank), the anti-slip effect is insufficient, since the frictional resistance is 45 g. By contrast, in the case of the knits using the high friction yarns of the examples, the frictional resistance is 55 g or greater in each case. Looking at the monitored value for sensation, the results confirm that a significant anti-slip effect is obtained.

Thus, in the sock of the present invention, it is desirable for at least the first functional area 1 or the second functional area 3 to have a frictional resistance of 55 g or greater, in order to achieve an effective gripping force. It is desirable for both the first functional area 1 and the second functional area 3 to have a frictional resistance of 55 g or greater.

In addition, 7 specimens were prepared using high friction yarns with a core yarn of polyurethane with thickness A Decitex and a floating yarn of polyester or nylon with thickness B Decitex, and varying the difference in thickness of the core yarn and the floating (A-B) within a range of 30-60 Decitex, yarn 5 Decitex at a time. The measurement results obtained by the same method as above are given in TABLE 3 below.

TABLE 3

| A-B (Decitex) | 30 | 35 | 40 | 45 | 50 | 55 | 60 |
|---|---|---|---|---|---|---|---|
| Frictional resistance (g) | 46 | 48 | 50 | 52 | 55 | 60 | 67 |

As shown in TABLE 3, when high friction yarn was used where the relationship A−B<50 Decitex obtains, the frictional resistance was less than 55 g. Based on the results of monitored sensations given in TABLE 2, it was considered impossible to feel sufficient gripping performance.

OTHER: By contrast, when high friction yarn was used where the relationship A−B≥50 Decitex obtains, frictional resistance of 55 g or greater was measured, so based on the results of TABLE 2, it was considered possible for the wearer of the sock to feel sufficient gripping performance.

Test 2

The purpose of Test 2 is to evaluate how the maximum values and integrated values of force in the direction of motion, when wearing the sock of the present invention while running.

The specimens of the example are those of a sock provided with a first functional area corresponding to the large toe portion, a second functional area corresponding to the base of the toes, and a high friction area above the heel, as illustrated in FIG. 1. The high friction yarn used a Pu(100d)×Ny(20d×2) covering yarn, and other than the foregoing, a cotton/acrylic yarn was used. When frictional force was measured by the method of Test 1, the first functional area, the second functional area, and the inside surface of the high friction area above the heel (the surface touching the sole) had a frictional resistance of 105 g, and a frictional resistance of 81 g for the outer surface (the surface touching the insole of the shoe). The frictional resistance of areas other than the foregoing was 45 g.

The specimens of the comparative example are those of an ordinary sock with all areas knitted with a cotton/acrylic yarn. When frictional force was measured by the method of Test 1, the frictional force was 45 g.

Test Method

Figure 7:
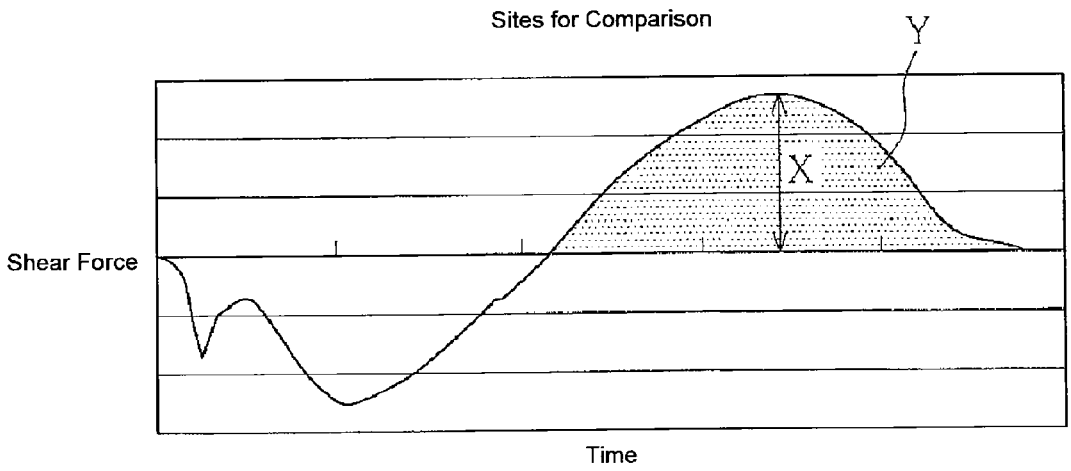
FIG. 7 is a graph showing a comparison of sites for maximum values and integrated values in a test measuring the ground reaction force when running on a track at 10 km/h using a sock of an example and a comparative example.

The test subjects were 5 randomly selected males with a foot length of 25-27 cm. The subjects wore the sock of the example and the sock of the comparative example, and the ground reaction force was measured when running on a track at 10 km/h. The ground reaction force was measured in terms of the maximum value and the integrated value. FIG. 7 is a graph showing an example of the measurement results for the ground reaction force. The maximum value of the ground reaction force is the value shown by X, and the integrated value of the ground reaction force is the area shown by Y where the shear force is 0 or greater.

Test Results

The measurement results for maximum values of ground reaction force obtained when running at 10 km/hr are given in TABLE 4 below. The integrated values of ground reaction force are given in TABLE 5 below.

TABLE 4

| | Comparative Example | Example |
|---|---|---|
| Test subject 1 | 156 | 161 |
| Test subject 2 | 217 | 232 |
| Test subject 3 | 179 | 184 |
| Test subject 4 | 172 | 173 |
| Test subject 5 | 217 | 247 |

Unit: (N)

TABLE 5

| | Comparative Example | Example |
|---|---|---|
| Test subject 1 | 4441 | 4569 |
| Test subject 2 | 6073 | 7106 |
| Test subject 3 | 6001 | 6401 |
| Test subject 4 | 4436 | 4532 |
| Test subject 5 | 6288 | 7355 |

Unit: (N)

The results given in TABLE 4 and TABLE 5 show that for each of the test subjects, the maximum values and the integrated values of force in the direction of motion were higher for the sock of the example than for the sock of the comparative example. Thus, when running at the same output, wearing the sock of the present invention more effectively transmitted force to the ground, and this was thought to increase the running speed.

As described above, the sock of the present invention has a needle-lowering area knitted by needle-lowering, and a needle-raising area knitted by needle-raising at designated positions within the toe area on the sole side of the sock, and arranged in the course direction, and the needle-lowering area and/or the needle-raising area form a first functional area knitted with functional yarns which differ from the knitting yarns of the other areas of the toe area on the sole side of the sock, thus making it possible to provide a functional area at a specified portion within the toe area on the sole side of the sock. If the first functional area is knitted with a functional yarn having high frictional resistance, for example, then the gripping force during the kicking off action can be increased, without interfering with the toes spreading laterally.

Furthermore, according to the present invention, it is possible to provide a functional area with a high anti-slip effect only in the process of knitting the sock, with no need for sewing and cutting, attaching pads, or applying chemicals. Therefore, the present invention is very effective in that it is able to offer a highly functional product while maintaining productivity and cost.

Moreover, in the past, there was the problem of significant loss in comfort, due to the fact that when an attempt was made to inlay with cut boss knitting in the toe portion, the knitted yarns on the inner surface of the sock continued to be extended, without being cut. However, according to the present invention, the comfort is very good, because the functional areas with high frictional resistance provided by reciprocating rotation knitting and the other adjacent areas form a smooth surface with no unevenness.

The present invention is not limited to the above example, and the embodiments may, of course, be advantageously modified within the scope of the technical ideas recited in the claims.

For example, the above example disclosed that the first functional area 1 and the second functional area 3 are knitted with functional yarns having high frictional resistance, but the functional yarns of the present invention are not limited thereto. For example, a high durability yarn is used in socks so that a hole does not readily form in the toe portion, and a high water absorption yarn is used in socks so that the toe portion does not readily become damp. Thus, the type of functional yarn can be selected depending on the use.

The above example disclosed that the first functional area 1 and the second functional area 3 are both knitted only with high friction yarns. However, high friction yarns and under yarns may be used together. In this case, exposure of the high friction yarns on the inside of the sock can be prevented.

Moreover, in the above example, the high friction yarn was formed by twisting a floating yarn around a core yarn, and then twisting a slack yarn. When polyurethane was used for the core yarn and wooly nylon was used for the floating yarn, and the thickness of the core yarn was A Decitex and the thickness of the floating yarn was B Decitex, the relationship A−B≥50 Decitex obtains for a high friction yarn. However, instead of using the above high friction yarn, a raw yarn may be used with a total filament grade of 30 Decitex or more, and formed from one or more filaments with a monofilament diameter of 1,000 nm or less.

If the monofilament diameter is 1,000 nm or less, then the surface area of the fibers increases, raising the frictional resistance, and is thus suitable as a functional yarn of the present invention. However, a total filament grade of 30 Decitex or more is desirable for ensuring strength while actually wearing the sock. Even if a yarn has less than 30 Decitex in a monofilament, the desired strength can be achieved by bundling multiple filaments of 30 Decitex or higher.

An example of such fibers is a yarn that can be used which is sold under the name "Nanofront" (trade name, Teijin Fibers Limited). If "Nanofront" of 39 Decitex and with 8,360 filaments is used, the present invention can achieve the required gripping force.

The above example disclosed a sock S with knitting in the direction from the opening welt 6 of the sock to the toe portion 7, but it is also suitable for the sock to be knitted from the toe portion 7 to the opening welt 6 of the sock.

However, if knitting is performed from the toe portion 7 to the opening welt 6 of the sock, then the relationship between needle-lowering and needle-raising in Embodiment 2 and Embodiment 7 is reversed. In other words, in Embodiment 2 and Embodiment 7, all instances of "needle-lowering area" shall become "needle-raising area," and conversely, all instances of "needle-raising area" shall become "needle-lowering area."

Thus, if the description of the sock of Embodiment 2 is re-written for knitting from the toe area 7 to the opening welt 6, it is described as follows.

A sock of Embodiment 1, wherein a sock is knitted from the toe portion to the opening welt, comprising a needle-raising area positioned on the large toe side, and a needle-lowering area positioned on the little toe side, with the knitted end of the needle-raising area serving as the knitting starting end in the wale direction to also form a second needle-lowering area (reverse knitting), and the needle-raising area and the second needle-lowering area are knitted so as to contain functional yarns in a specified ratio, thereby making it possible to form a first functional area.

If the description of the sock of Embodiment 7 is re-written for knitting from the toe area 7 to the opening welt 6, it is described as follows.

A sock of Embodiment 4 or 5, wherein the second functional area is provided by knitting a third needle-lowering area by needle-lowering knitting (reverse knitting), and then a second needle-raising area is knitted by continuous needle-raising knitting (reverse knitting).

The above example discloses that the second functional area 3 is provided by knitting a second needle-lowering area 3*a* by needle-lowering knitting, and then knitting a third needle-raising area 3*b* is knitted by continuous needle-raising knitting. However, the second functional area 3 may be knitted by cut boss knitting with a functional yarn as an inlay yarn. In this case, the second functional area 3 can be given a flat shape along the surface which touches the ground. Also, the impact of the base of the toes can be suitably absorbed.

The above example disclosed that the knitting course control area 5 is knitted by tuck knitting, but as long as the knitting stitches can be knitted more densely, the knitting course control area 5 may be knitted by a method other than tuck knitting.

What is claimed is:

1. A sock comprising:

a toe portion;

a first functional area formed in a sole of the toe portion so as to contain a functional yarn, the first functional area comprising a needle-lowering area which is knitted to widen the needle-lowering area in a course direction towards a toe of the sock by lowering a knitting needle from a non-knitting level to a knitting level at a regular interval; and a needle-raising area formed in the sole of the toe portion outside the first functional area in alignment with the needle-lowering area in the course direction, wherein the needle-raising area is knitted to narrow the needle-raising area in the course direction towards the toe of the sock by raising the knitting needle from the knitting level to the non-knitting level at a regular interval.

2. A sock according to claim 1, wherein the needle-lowering area is positioned on a large toe side, and the needle-raising area is positioned on a little toe side, the first functional area further comprises a second needle-raising area formed continuous in the wale direction towards the toe of the sock from the needle-lowering area, and the needle-lowering area and the second needle-raising area are knitted so as to contain the functional yarn in a specified ratio.

3. The sock according to claim 1, wherein the functional yarn contained in the first functional area has a higher frictional resistance than yarn forming areas in the sole of the toe portion outside the first functional area.

4. The sock according to claim 1, further comprising a second functional area formed in the sole of the sock adjacent to a base of the toe portion and knitted to contain the functional yarn in a specified ratio.

5. The sock according to claim 1, wherein the first functional area and the second functional area are knitted only with the functional yarn.

6. The sock according to claim 4, wherein the second functional are is cut boss knitted with the functional yarn as an inlay yarn.

7. The sock according to claim 4, wherein the second functional area comprises a second needle-lowering area and a third needle-raising area formed continuous from the second needle lowering area.

8. The sock according to claim 4, further comprising a knitting course control area adjacent to a heel side of the second functional area, the knitting course control area is a tighter knit in a periphery on a sole half than on a top half of the sock.

9. The sock according to claim 8, wherein the knitting course control area is knitted by tuck knitting, with 25-45 courses in the sole half of the sock, and with 55-75 courses in the top half of the sock.

10. The sock according to claim 1, wherein the functional yarns comprises high friction yarns formed in such a way in which floating yarns are twisted around core yarns, which are then twisted with slack yarns, in which the core yarns are made of polyurethane, the floating yarns are made of wooly nylon, and A−B≥50 Decitex stands, where the core yarns have a thickness of A Decitex and the floating yarns have a thickness of B Decitex.

11. The sock according to claim 1, wherein the functional yarns comprise raw yarns having a total filament grade of 30 Decitex or more, and formed from one or more filaments with a monofilament diameter of 1,000 nm or less.

* * * * *